US010147992B2

(12) United States Patent
U-Yen et al.

(10) Patent No.: US 10,147,992 B2
(45) Date of Patent: Dec. 4, 2018

(54) PLANAR VIA-LESS CROSSOVER HAVING COPLANAR WAVEGUIDE CONFIGURATIONS AND STUB LAYERS

(71) Applicant: The United States of America as represented by the Administrator of the National Aeronautics and Space Administration, Washington, DC (US)

(72) Inventors: Kongpop U-Yen, Arlington, VA (US); Edward J. Wollack, Clarksville, MD (US); Marc Castro, San Antonio, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 15/194,747

(22) Filed: Jun. 28, 2016

(65) Prior Publication Data

US 2017/0373365 A1 Dec. 28, 2017

(51) Int. Cl.

| | |
|---|---|
| ***H01P 3/00*** | (2006.01) |
| ***H01P 3/08*** | (2006.01) |
| ***H01P 5/02*** | (2006.01) |

(52) U.S. Cl.

CPC ..... *H01P 3/003* (2013.01); *H01P 3/006* (2013.01); *H01P 3/088* (2013.01); *H01P 5/028* (2013.01)

(58) Field of Classification Search

CPC .. H01P 3/08; H01P 3/081; H01P 3/088; H01P 3/003; H01P 3/006

USPC ..... 333/1, 246

See application file for complete search history.

(56) References Cited

U.S. PATENT DOCUMENTS

| | | | | |
|---|---|---|---|---|
| 5,117,207 | A * | 5/1992 | Powell et al. | H01P 3/081 333/1 |
| 2014/0133114 | A1* | 5/2014 | Saji et al. | H05K 1/0253 361/760 |
| 2014/0306776 | A1* | 10/2014 | Eom et al. | H01P 3/003 333/1 |
| 2015/0236393 | A1* | 8/2015 | Saji et al. | H01P 3/08 333/238 |

* cited by examiner

*Primary Examiner* — Benny Lee

(74) *Attorney, Agent, or Firm* — Christopher O. Edwards; Bryan A. Geurts; Mark P. Dvorscak

(57) ABSTRACT

A via-less crossover for use in broadband microwave/mm-wave circuitry, including: a dielectric substrate; a top layer disposed on one side of the substrate and including a microstrip line with an input and an output, two tapered sections placed around the microstrip line along a co-planar waveguide (CPW) central line, one microstrip portion having an input and which connects to one top layer, rectangular stub disposed adjacent to one of the tapered sections, and another microstrip portion having an output and which connects to another top layer, rectangular stub disposed adjacent to the other of the tapered sections; and a ground layer disposed on an opposite side of the substrate and including a bottom layer CPW central line situated in a central cutout and which connects between a bottom layer, rectangular stub on one side and a bottom layer, rectangular stub on the other side situated in ground cutouts, respectively.

7 Claims, 3 Drawing Sheets

PLANAR VIA-LESS CROSSOVER HAVING COPLANAR WAVEGUIDE CONFIGURATIONS AND STUB LAYERS

BACKGROUND OF THE INVENTION

Field of the Invention

The present invention relates in general to a crossover and, more particularly, to a microwave/millimeter (mm)-wave planar via-less crossover that can be physically scaled to operate at any microwave/mm-wave frequency and is suitable for use in a variety of applications including, but not limited to, planar microwave/mm-wave integrated circuits.

Description of the Related Art

Accordingly, a crossover allows microwave/mm-wave transmission lines to cross while maintaining signal integrity in each line. There are three basic planar crossover techniques that have been employed and include four ports which are on the same layer: 1) air bridges, 2) wired vias, and 3) and via-less crossovers. Of the three, via-less crossovers utilize a limited number of metalized layers, however, are the most complex from an electromagnetic perspective. Via-less crossovers typically have a limited operating frequency bandwidth and also can have low isolation between two crossing lines.

In order to improve the bandwidth of the via-less crossover, broadside microstrip-CPW (co-planar waveguide) couplers were used with the crossing length designed to be approximately a half-wavelength long at the center of the operating frequency. Another solution used microstrip-slotline transitions to convert a microstrip to a co-planar waveguide (CPW) line on the ground plane side of the substrate. In addition, the other solution used a cavity resonance structure to isolate two crossing lines on the same microstrip plane.

However, the related art has disadvantages in that the crossover either has limited operating frequency bandwidth or has low isolation between two crossing microstrip lines. Wide band operation and high isolation were not achieved simultaneously.

SUMMARY OF THE INVENTION

An apparatus consistent with the present disclosure provides a via-less crossover that employs a microstrip to co-planar waveguide (CPW) transition for both the broadside and the uniplanar transitions because of its wide bandwidth, high isolation, and low radiation loss properties.

In one embodiment, the present invention includes a via-less crossover for use in broadband microwave/mm-wave circuitry, comprising: a dielectric substrate; a top layer disposed on one side of the substrate and including a top microstrip line with an input and an output and a co-planar waveguide (CPW) central line of reduced width, two tapered sections which are placed around the top microstrip line such that a tapered section is disposed adjacent to and along each side of the CPW central line of reduced width to allow gradual impedance transformation, one microstrip portion having an input and which connects to one top layer stub disposed adjacent to one of the two tapered sections, and another microstrip portion having an output and which connects to another top layer stub disposed adjacent to the other of the two tapered sections; and a ground layer disposed on an opposite side of the substrate and including a bottom layer CPW central line situated in a central cutout and which connects between a bottom layer stub on one side and another bottom layer stub on the other side situated in ground cutouts, respectively.

In one embodiment, in the via-less crossover, the top layer stubs and bottom layer stubs are rectangular in shape, and an upper face of the bottom layer, rectangular stub on the one side is situated on the substrate below a bottom face of the one top layer, rectangular stub, while an upper face of the other bottom layer, rectangular stub on the other side is situated on the substrate below a bottom face of the other top layer, rectangular stub.

In one embodiment, the via-less crossover has a bandwidth from 115 to 235 GHz.

In one embodiment, in the via-less crossover, a width (W5) in the ground cut outs is a quarter of the effective wavelength of 235 GHz, and a length (L6) of each of the two CPW tapered sections is half of the effective wavelength.

In one embodiment, in the via-less crossover, the substrate is formed from high resistivity silicon having a thickness of 5 μm and a permittivity of 11.55.

In one embodiment, in the via-less crossover, the two tapered sections are formed of metal.

In one embodiment, in the via-less crossover, each of the two tapered sections is generally arrowhead-shaped, with the point thereof facing away from the co-planar waveguide (CPW) central line of reduced width.

In one embodiment, the via-less crossover leads to a reduction in radiation losses.

In one embodiment, the via-less crossover is formed as part of a polarization sensitive millimeter wave sensor.

In one embodiment, an apparatus consistent with the present disclosure provides millimeter-wave circuit having at least one via-less crossover, wherein the via-less crossover has a bandwidth from 115 to 235 GHz (i.e., a fractional bandwidth of 0.68).

Thus has been outlined, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

DETAIL DESCRIPTION OF THE INVENTION

According to the present disclosure, a via-less crossover is used as part of the detector for a broadband millimeter wave circuit, the via-less crossover preferably has a bandwidth from 115 to 235 GHz (i.e., a fractional bandwidth >0.68).

Figure 1A:
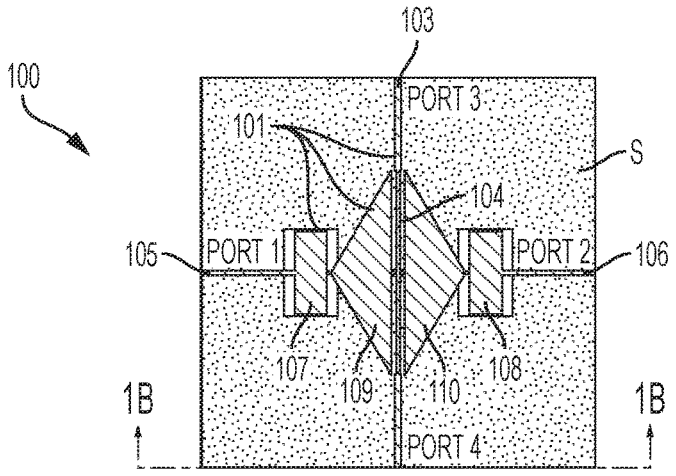
FIG. 1A is a top plan view of a via-less crossover according to an exemplary embodiment consistent with present disclosure.
Figure 1B:
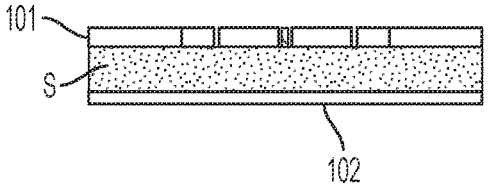
FIG. 1B is a schematic side view showing the substrate in relation to the top layer and ground layer, as viewed from the lower side edge of FIG. 1A.
Figure 1C:
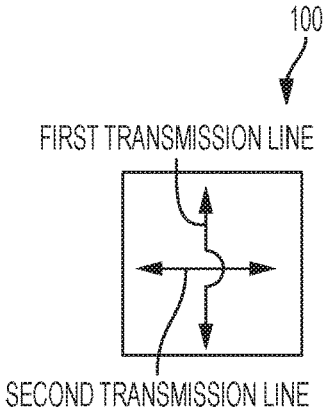
FIG. 1C is a schematic view of a via-less crossover according to an exemplary embodiment consistent with present disclosure.
Figure 2A:
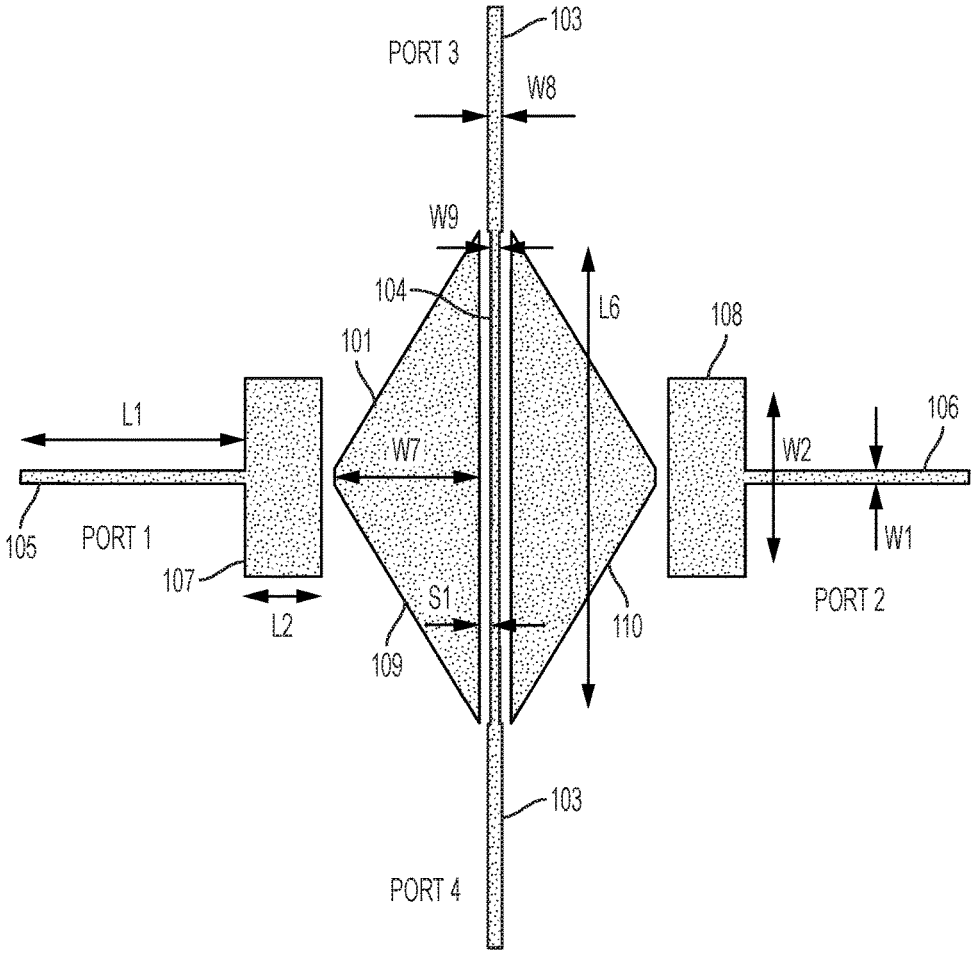
FIG. 2A is a plan view of the top layer alone of a via-less crossover according to an exemplary embodiment consistent with present disclosure.

FIG. 1A is a top plan view, and FIGS. 1B and 1C are schematic views of a via-less crossover 100 according to an exemplary embodiment consistent with present disclosure. FIG. 2A is a plan view of the top layer or plane alone, and FIG. 2B is a plan view of the ground plane alone of a via-less crossover according to an exemplary embodiment consistent with present disclosure.

In particular, as shown in FIGS. 1A and 1B, the crossover 100 (FIGS. 1A and 1C) is designed on a dielectric substrate such as a single crystal silicon substrate S and includes a top layer or plane 101, and a ground layer or plane 102 on the bottom (note that top layer 101 is hatched in FIG. 1A for contrast). FIG. 1B is a schematic side view showing the substrate S in relation to the top layer 101 and ground layer 102 (FIG. 1B), as viewed from the lower side edge of FIG. 1A. Exemplary dimensions of the crossover are a thickness of 5 μm for the silicon substrate S, a width=0.423 mm, and a height or length=0.420 mm. The top layer 101 of the crossover 100 includes four ports labeled as Port 1, Port 2, Port 3, and Port 4 in FIGS. 1A and 2A. For example, Port 3 is an input and Port 4 is an output of a top microstrip line 103 and forms a first transmission line as shown in FIGS. 1A and 2A. The top microstrip line 103 includes a CPW central line 104 of reduced width. Further, for example, Port 1 is an input to microstrip portion 105 and Port 2 is an output from microstrip portion 106. The microstrip portion 105 connects to a top layer, rectangular stub 107 on one side, while the microstrip portion 106 connects to a top layer, rectangular stub 108 on the other side. One top CPW tapered section 109 is disposed adjacent to one side of the reduced width central line 104, while another top CPW tapered section 110 is disposed adjacent to the other side of the reduced width central line 104.

In FIG. 1.A, the section 1B-1B indicates that FIG. 1B is a side view of FIG. 1A.

Figure 2B:
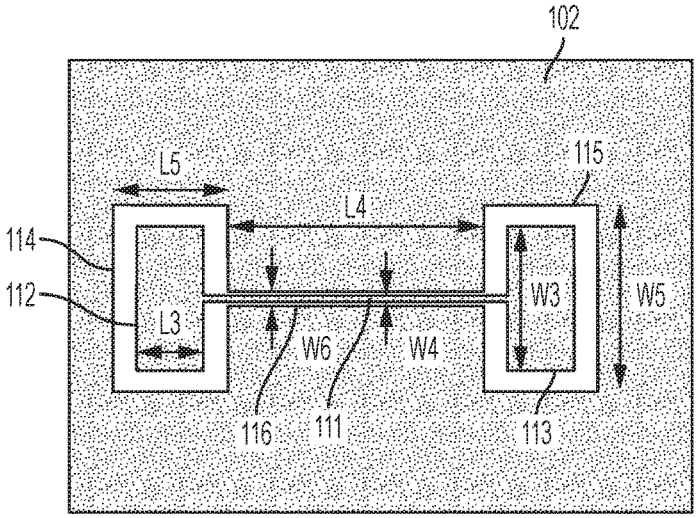
FIG. 2B is a plan view of the ground plane alone of a via-less crossover according to an exemplary embodiment consistent with present disclosure.

With reference to FIG. 2B, a bottom layer CPW central line 111 is situated in a central cutout 116 and connects between a bottom layer, rectangular stub 112 on one side and a bottom layer, rectangular stub 113 on the other side situated in ground cutouts 114 and 115, respectively (note that in FIG. 1A a small portion of the substrate S has been removed at the center between the two tapered sections 109 and 110, as well as the rectangular portions of the substrate S surrounding the rectangular stubs 107 and 108, so that the bottom layer CPW central line 111 is visible from the top view for ease of understanding and to show the crossing over of the two lines). An upper face of the bottom layer, rectangular stub 112 is situated on the silicon substrate S directly below a bottom face of the top layer, rectangular stub 107, while an upper face of the bottom layer, rectangular stub 113 is situated on the silicon substrate S directly below a bottom face of the top layer, rectangular stub 108.

The top layer microstrip portion 105 connected to the top layer, rectangular stub 107 on one side, the bottom layer, rectangular stub 112 on the one side, the bottom layer CPW central line 111, the bottom layer, rectangular stub 113 on the other side, and the top layer microstrip portion 106 connected to the top layer, rectangular stub 108 on the other side together form a double vertical interconnect to achieve electromagnetic coupling between the top and bottom sides of the substrate S, so as to provide a second transmission line which is perpendicular to the first transmission line (i.e., the first transmission line crosses over the second transmission line as shown schematically in FIG. 1C).

FIG. 1C shows a first transmission line crossing a second transmission line.

With reference to FIGS. 2A and 2B, values of exemplary design parameters are as follows (dimensions are in (mm)):

W1 (width of microstrip portions 105, 106)=0.006, W2 (width of top layer, rectangular stubs 107, 108)=0.088 as shown in FIG. 2A, W3 (width of bottom layer, rectangular stubs 112, 113)=0.074, W4 (width of bottom layer CPW central line 111)=0.0027, W5 (width of ground cutouts 114, 115)=0.095, W6 (width of bottom layer CPW central cutout 116)=0.0073 as shown in FIG. 2B, W7 (width of the top CPW tapered sections 109 and 110)=0.064, W8 (width of microstrip line 103)=0.006, W9 (width of CPW central line 104)=0.004, L1 (length of microstrip portions 105, 106 between ports 1, 2 and top layer, rectangular stubs 107, 108, respectively)=0.1, L2 (length of top layer, rectangular stubs 107, 108)=0.034 as shown in FIG. 2A, L3 (length of bottom layer, rectangular stubs 112, 113)=0.034, L4 (length between ground cutouts 114 and 115)=0.130, L5 (length of ground cutouts 114, 115)=0.059 as shown in FIG. 2B, L6 (length of top CPW tapered sections 109 and 110)=0.220, and S1 (distance between each of the top CPW tapers 109, 110 and the CPW central line 104 of microstrip line 103)=0.0055 as shown in FIG. 2A.

The crossover 100 structure can be scaled to the desired operating frequency spectrum and modified to increase line isolation. The width of each of the ground cutouts 114, 115 (W5) is a quarter of the effective wavelength of 235 GHz and the length of each of the top CPW tapered sections 109 and 110 (L6) is half of the effective wavelength.

With reference to FIGS. 2A and 2B, the microstrip portion 105 (FIG. 2A) is converted to a CPW line 111 (FIG. 2B) on the ground plane layer 102 (FIG. 2B) of the microstrip line. The conversion is accomplished using the quarter-wave open-ended coupled line. Using this approach, maximum signal coupling can be achieved with minimal lateral phase delay between the connecting ports. This feature allows two crossing branches to be phase balanced with minimal physical real estate. Also, the CPW line 104 FIG. 2A is approximately half-wavelength long around the crossing area. When connected with the microstrip-CPW mode converter mentioned above, the structure introduces three transmission poles within the operating frequency band. This technique significantly improves the operating bandwidth. Finally as shown in FIG. 2B, the width of the ground plane cutouts 114, 115 (W5) and the center line 111 of the CPW on the bottom ground plane 102 is maintained at minimum value to reduce radiation and cross-coupling to the top microstrip line 103.

Moreover, each of the two tapered sections 109 and 110 as shown in FIG. 2A is generally arrowhead-shaped, with the point thereof facing away from the co-planar waveguide (CPW) central line 104 of reduced width. The two tapered sections 109 and 110 are formed of metal and are placed around the top microstrip line 103 along the CPW central line 104 of reduced width to allow gradual impedance transformation to the grounded CPW central line 104 at the center of the crossing. Thus, the top co-planar waveguide (CPW) tapered sections 109 and 110 are operative to gradually transform the signal entering Port 3 from microstrip mode to CPW mode, improving the impedance match of the transition. This structure also reduces radiation loss generated by the bottom layer CPW central line 111. In particular, the top CPW tapered sections 109 and 110 also improve the isolation from the bottom layer CPW central line 111 by creating cross-polarized fields between the two lines. Isolation is further improved by narrowing the width of the center strip as at 104 and spacing of both top and ground plane coplanar waveguides. The dielectric substrate S is formed from high resistivity silicon having a thickness of 5 μm and a permittivity of 11.55. A silicon having a high resistivity (or higher grade such as float zone or infrared (IR) grade) is preferred for this substrate material.

For cryogenic applications, the top and ground planes are simulated as superconductors, using the following equation as the sheet resistance:

$$Z_S = j\omega\mu_0\lambda_L\coth\left(\frac{t}{\lambda_L}\right)$$

where ω is frequency in radians per second; where $\mu_o$ is the permittivity of free space; the London penetration depth ($\lambda_L$) is 95 run; and t is the thickness of the conductive layers, the top being 250 nm and the bottom being 500 nm. For room temperature applications the top and ground planes are normal metals.

The via-less crossover according to an exemplary embodiment consistent with present disclosure thus allows two microwave or millimeter (mm)-wave microstrip lines to cross each other without any need for a physical bridge and with minimal crosstalk between the two lines and over broad ranges of frequencies. The present via-less crossover also minimizes signal interference between two lines at a significant level.

Figure 3B:
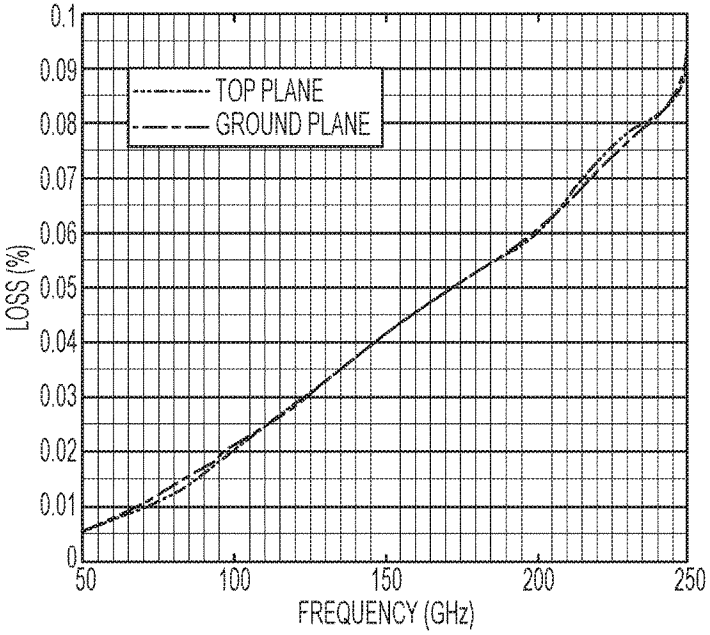
FIGS. 3A and 3B are graphs showing the scattering parameters and radiation loss, respectively, of a via-less crossover according to an exemplary embodiment consistent with present disclosure.
Figure 3A:
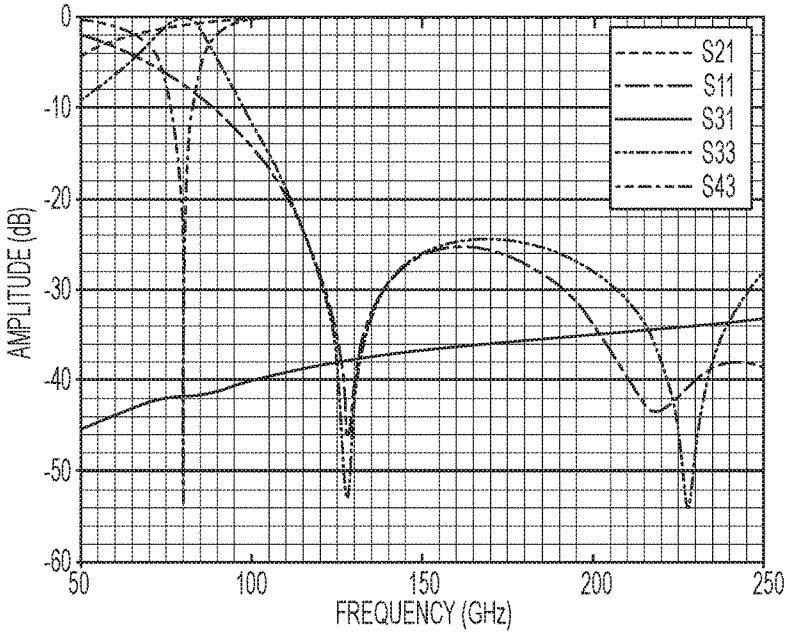

FIGS. 3A and 3B are graphs showing the scattering parameters (i.e. $S_{11}$, $S_{21}$, $S_{31}$, $S_{33}$, $S_{43}$) measured by Amplitude in dB and radiation loss measured in dB, respectively, vs. Frequency in GHz of a via-less crossover according to an exemplary embodiment consistent with present disclosure. The crossover was simulated in Ansys HFSS. It had a return loss of 22 dB and isolation of 34 dB as shown in FIG. 3A. The total radiation loss, shown in FIG. 3B, was kept under 0.001 by keeping the spacing in both top and ground CPW small compared to the radiation wavelength.

Further, when the top plane 101 and ground plane 102 are misaligned during photolithography in a via-less crossover 100 according to an exemplary embodiment consistent with present disclosure, the sensitivity of the parameters was analyzed to account for the possible misalignment of the photolightography mask of +/−0.25 μm. The sensitivity of the crossover is relatively minor, with a shift of 0.25 down resulting in a return loss of 21 dB and as isolation of 33 dB.

It can be seen that a via-less crossover 100 according to an exemplary embodiment consistent with present disclosure has the largest fractional bandwidth and highest isolation, as shown in Table 1:

TABLE 1

Performance comparison of via-less crossovers

| Design | This work | [1] | [4] | [5] | [6] | [7] | [8] | [9] |
|---|---|---|---|---|---|---|---|---|
| Bandwidth (%) | 130 | 110 | 44 | 20 | 26 | 33 | 14 | 40 |
| Isolation | 34 | 15 | 26 | 19 | 18 | 20 | 13 | 15 |

Since a crossover is used in multiple complex microwave systems, it has various potential applications. For example, as discussed above, the present via-less crossover will be implemented by NASA in superconducting millimeter wave detectors. For commercial applications (for both ground and space), the present via-less crossover can be used as a part of microwave array networks such as switch matrices, antenna beam forming networks and other communication systems that require broadband operating frequencies and high isolation among microwave lines, especially in an integrated circuit form. The present via-less crossover is also suitable for use in various other applications that require complex mm-wave line on-chip interconnection.

It should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

What is claimed is:

1. A via-less crossover for use in broadband microwave/mm-wave circuitry, comprising:

a dielectric substrate;

a top layer disposed on one side of the substrate and including a top microstrip line with an input and an output and a co-planar waveguide (CPW) central line of reduced width, two tapered sections which are placed along the top microstrip line such that respective ones of the two tapered sections are disposed adjacent to and along a corresponding side of the CPW central line of reduced width to allow gradual impedance transformation, one microstrip portion having another input and which connects to one top layer stub disposed adjacent to one of the two tapered sections, and another microstrip portion having another output and which connects to another top layer stub disposed adjacent to the other of the two tapered sections; and a ground layer disposed on an opposite side of the substrate and including a bottom layer CPW central line situated in a central cutout and which connects between a bottom layer stub on one side of the bottom layer CPW central line and another bottom layer stub on the other side of the bottom layer CPW central line situated in ground cutouts, respectively;

wherein the top layer stub and bottom layer stub are each rectangular in shape, and wherein an upper face of the bottom layer, rectangular stub on the one side is situated on the substrate below a bottom face of the one top layer, rectangular stub, while an upper face of the other bottom layer, rectangular stub on the other side is situated on the substrate below a bottom face of the other top layer, rectangular stub.

2. The via-less crossover of claim 1, wherein the via-less crossover leads to a reduction in radiation losses.

3. The via-less crossover of claim 1, wherein the via-less crossover has a bandwidth from 115 to 235 GHz, which corresponds to a fractional bandwidth of 0.68.

4. The via-less crossover of claim 1, wherein a width (W5) of each of the ground cutouts is a quarter of the effective wavelength of 235 GHz, and a length (L6) of each of the two CPW tapered sections is half of the effective wavelength.

5. The via-less crossover of claim 1, wherein the substrate is formed of high resistivity silicon having a thickness of 5 μm and a permittivity of 11.55.

6. The via-less crossover of claim 1, wherein the two tapered sections are formed of metal.

7. The via-less crossover of claim 1, wherein each of the two tapered sections is generally arrowhead-shaped, with each of the arrowhead-shaped tapered sections having a point facing away from the co-planar waveguide (CPW) central line of reduced width.

* * * * *